United States Patent [19]

D'Andrade et al.

[11] 4,445,297

[45] May 1, 1984

[54] TOY MOTORCYCLE WITH LIGHTING MECHANISM

[75] Inventors: Bruce M. D'Andrade, Whitehouse Station, N.J.; Ping F. Ng; Tak M. Ma, both of Hong Kong, Hong Kong

[73] Assignee: ARCO Industries Ltd., Hong Kong, Hong Kong

[21] Appl. No.: 373,421

[22] Filed: Apr. 30, 1982

[51] Int. Cl.[3] ..... A63H 17/28

[52] U.S. Cl. ..... 46/230; 46/228

[58] Field of Search ..... 46/226, 230, 228, 209, 46/206

[56] References Cited

U.S. PATENT DOCUMENTS

| | | | |
|---|---|---|---|
| Re. 30,299 | 6/1980 | Greenwood | 46/206 |
| 1,943,160 | 1/1934 | Brubaker | 46/230 |
| 2,603,911 | 7/1952 | Ernst | 46/206 |
| 2,697,306 | 12/1954 | Müller | 46/206 |
| 2,829,467 | 4/1958 | Pagano | 46/209 |
| 3,751,851 | 8/1973 | Nagai | 46/206 |
| 4,056,744 | 11/1977 | Blanchard et al. | 310/162 |
| 4,061,936 | 12/1977 | Woolley | 310/162 |
| 4,193,223 | 3/1980 | D'Andrade et al. | 46/209 |
| 4,201,011 | 5/1980 | Cook | 46/209 |
| 4,274,225 | 6/1981 | Knauff et al. | 46/226 |

FOREIGN PATENT DOCUMENTS

| | | | |
|---|---|---|---|
| 880569 | 7/1953 | Fed. Rep. of Germany | 46/230 |
| 708469 | 5/1954 | United Kingdom | 46/230 |
| 2014464 | 8/1979 | United Kingdom | 46/230 |

*Primary Examiner*—Robert A. Hafer
*Assistant Examiner*—Paul S. Polakowski
*Attorney, Agent, or Firm*—C. Hercus Just

[57] ABSTRACT

A toy motorcycle having at least one electric light bulb thereon and comprising an elongated frame having front and rear portions supporting wheels for free rotation and a central portion comprising, in combination, a gear train having interengaging gears supported on shafts extending transversely to the vertical plane of the frame and rotatably mounted in bearings in opposite side plates of the housing, an inertia flywheel rotatable upon another transverse shaft parallel to the others, an electric armature fixed coaxially to the flywheel for rotation therewith, a stationary field coil supported by one side plate of the housing coaxially with the armature, and a transverse axle extending at opposite ends through bearings in the side plates of the housing to which drive wheels are connected on opposite ends thereof and positioned outwardly from opposite sides of the enclosure for the housing for frictional engagement with a supporting surface to cause rotation of the inertia flywheel to energize the same by manually pushing the motorcycle upon a supporting surface followed by releasing it so as to be driven by the drive wheels as powered by the inertia flywheel and also generate current to light the electric light bulb on the motorcycle.

5 Claims, 6 Drawing Figures

TOY MOTORCYCLE WITH LIGHTING MECHANISM

BACKGROUND OF THE INVENTION

The present invention pertains to a toy motorcycle of the type driven by an inertia flywheel which operates through a gear train to drive a pair of auxiliary side wheels extending beyond the opposite sides of the elongated frame of the motorcycle for the dual purpose of cooperating with the front and rear wheel to support the motorcycle against sidewise tilting and also effect driving of the motorcycle while the front and rear wheels merely revolve without driving.

Toy motorcycles having front and rear wheels have been developed heretofore. One of the objectives in the toy motorcycles developed previously has been to provide a gyroscopic mechanism to maintain the motorcycle vertical with respect to a supporting surface while the motorcycle has only a front and rear wheel to support it upon said surface, and one of the wheels being driven by the gyroscopic mechanism. Typical examples of toys of this type are the subject matter of prior U.S. Pat. Nos. Re 30,299 to Greenwood, dated June 10, 1980 and being a re-issue of U.S. Pat. No. 3,650,067. Another such patent is U.S. Pat. No. 2,829,467, to Pagano, dated Apr. 8, 1958.

In view of the fact that the present invention also is interested in developing electric current incident to driving the motorcycle over a supporting surface, prior art pertaining to toys which develop electric current also have been investigated and it is found that, at least in a broad sense, the development of electric current by electric generating means driven by toy vehicles in motion comprise the subject matter of prior U.S. Pat. Nos. 4,193,223, to D'Andrade, the applicant in the present application, said patent being dated Mar. 18, 1980, and U.S. Pat. Nos. 4,274,225, to Knauff et al, dated June 23, 1981, these patents respectively pertaining to toy automobiles and at least the second of said patents having a console to develop sound and lighting effects which are transmitted to a toy vehicle when interconnected to the console for purposes of providing light and noise effect in the vehicle.

Still other means for generating electric current in wheeled toys comprise the subject matter of British Pat. No. 708,469, dated May 5, 1954, and entitled "Mechanical Toys Propelled by Inertia-Wheel Motors", and German Pat. No. 880,569, dated June 22, 1953, and pertaining what appears to be a toy automobile.

The present invention comprises an improvement over the toy vehicles and in particular the light generating means of the devices comprising the subject matter of said aforementioned prior patents, details of the invention being set forth below.

SUMMARY OF THE INVENTION

It is among the principal objects of the present invention to provide a toy motorcycle having at least one electric light mounted upon an elongated frame having front and rear portions extending from a central enclosure, said frame being preferably composed of shell-like side section molded from plastic material and connectable together by appropriate means, front and rear wheels being supported upon opposite ends of the frame for free rotation, and the central enclosure of the frame containing a metal housing in which a gear train is supported upon various shafts, one of which is a drive shaft which extends transversely with respect to the frame and opposite ends project beyond opposite sides thereof for purposes of supporting a pair of driving wheels positioned outwardly beyond the sides of the frame for the dual purpose of cooperating with the front and rear wheels to support the motorcycle in substantially vertical position without appreciable tilting and also drive the motorcycle, the drive wheel being powered by an inertia flywheel driven by a gear train mounted within the metal housing and interconnected between the drive shaft and a shaft upon which the inertial flywheel is supported in conjunction with generating means for electric current associated with the flywheel and also contained within the metal housing, the arrangement being such that when the inertial flywheel has been energized by successive manual pushing movements of the motorcycle while the drive wheels thereof engage a supporting surface, the inertia flywheel also operates the electric generating mechanism to develop a current to illuminate the one or more lights supported upon the frame of the motorcycle.

It is another object of the invention to provide said electric generating mechanism in the form of a stator which comprises finger-like pole pieces spaced circumferentially around the perimeter of an armature and projecting from one face of a wire field coil, and an electric circuit extending from one end of the coil to the metal housing to provide a ground connection and said circuit also extending from the other end of said coil to the electric light bulbs to illuminate the same while the armature is rotating. A still further object of the invention is to include commutator means connected in said electric circuit and comprising metal contacts in the circuit engageable with the drive shaft to comprise part of the circuit and including an interrupted sleeve of insulation material on said axle engageable with said metal contacts and operable to lift them from engagement with the axle sequentially to interrupt the supply of current to said electric light bulb and thereby provide intermittent lighting thereof.

Still another object of the invention is to form the finger-like pole pieces of said stator by having half of the pole pieces comprise the outer ends of fingers bent perpendicularly from radial fingers within a plane adjacent one side of said field coil, and the other half of said pole pieces comprise fingers stamped from the metal side plate of the housing which supports said field coil and bent perpendicularly to the plane of said side plate and interspersed between the first half of said pole pieces to form a circular pattern thereof surrounding the periphery of said electric armature.

One further object of the invention is to form the front end portions of the shell-like side sections so as to provide bearing means to support the upper end of a fork for the front wheel to provide limited rotation of the same in steering direction, the shell-like side sections also being provided at the upper edges thereof with a top shell-like member overlying said upper edges, and a bottom plate extends between and is connected to the lower edges of said side sections.

Still another object of the invention is to provide on the interior of said central enclosure portion of the elongated frame a mechanism to produce a clacking sound somewhat resembling the sound of a motorcycle and comprising a sound-generating leaf spring connected at one end to the interior of said enclosure and said spring engaging the teeth of one of the gears of said gear train to effect said clacking sound when said motorcycle is in motion.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENT OF THE INVENTION

Figure 1:
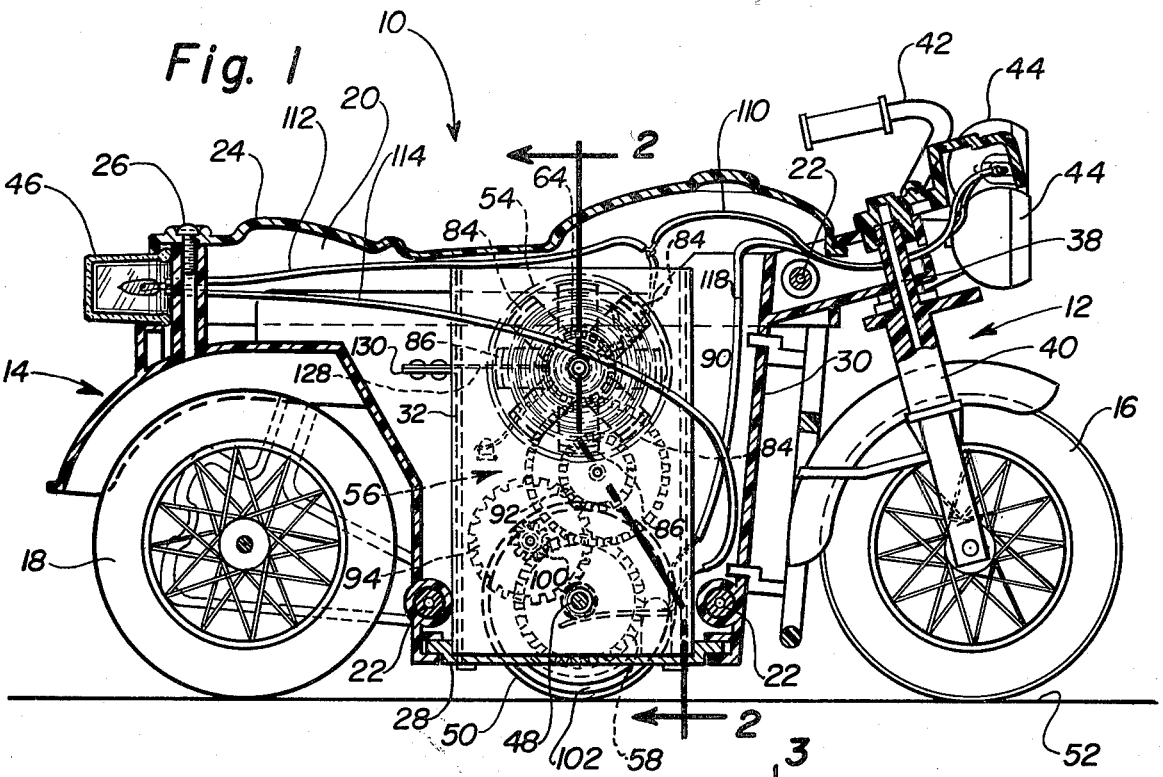
FIG. 1 is a vertical sectional view taken through the toy motorcycle embodying the principles of the invention and showing the gear train for the electric generator supported within a central enclosure within the frame of the motorcycle.

Referring to FIG. 1, in which a vertical sectional view of the toy motorcycle 10 is shown which incorporates the principles of the invention, it will be seen that sectioned edges of an elongated frame is illustrated which includes front and rear portions 12 and 14 which respectively support freely rotatable front and rear wheels 16 and 18. The elongated frame of the motorcycle 10 preferably comprises a pair of mating shell-like side sections of which only one section 20 is shown in FIG. 1 as outlined by the cross-sectioned illustrations designating the preferred material as being a suitable plastic material. The shell-like sections comprising the side members such as section 20 are connected together by appropriate plugs and sockets 22 and may include cement. The upper portion of the connected side pieces are covered by a top shell-like member 24 and connected by screw means 26, and the lower portion of the side shell members is closed by a bottom plate 28.

The elongated frame also is shaped to have a central enclosure 30 within which a metal housing 32 is mounted. The housing 32 is illustrated in vertical transverse section in FIG. 2 on a larger scale than employed in Fig. 1, and also in FIG. 2, there is no illustration of the shell-like side pieces but it will be understood that in FIG. 2, they closely overlie the side plates 34 and 36 of the metal housing 32. The metal housing 32 contains and supports a gear train and electric current generating means described in detail hereinafter. Also, referring to FIG. 1, front portion 12 of the elongated frame contains suitable bearings which rotatably receive the upper portion 38 of a fork 40 which supports the front wheel 16 and permits limited rotation of the same about the axis of the upper portion 38. Said upper portion also includes a handlebar 42 which also supports one or more electric lights 44 and the rear portion 14 of the elongated frame supports another electric light 46, said electric lights including minute type electric light bulbs adapted to be illuminated by the electric current generated by the means within the metal housing 32 as described in detail below.

The housing 32 preferably is formed from metal for purposes of providing a ground for the circuit between the electric generating means and the electric lights 44 and 46 as also set forth below. The lower portions of the side plates 34 and 36 of the housing 32 have bearings formed therein through which a drive shaft 48 extends the opposite ends respectively projecting outwardly from the side plates 34 and 36 for purposes of supporting drive wheels 50 which are fixed to said outer ends of shaft 48. Preferably, the rims of the drive wheels 50 are of a friction nature which preferably comprises a simple tire such as a rubber band of appropriate width, or otherwise, whereby the drive wheels 50 may be engaged with a supporting surface 52 shown in FIGS. 1 and 2 so that the toy motorcycle may be manually pushed a number of times while the wheels 50 engage the surface for purposes of accelerating the inertia wheel 54 by means of a gear train 56 of which a drive gear 58 is fixed to drive shaft 48. When the inertia wheel 54 has been energized to the desired extent, the motorcycle is released for forward movement powered by the rapidly rotating inertia wheel 54. Also, the lower surfaces of the drive wheels 50 preferably are within a plane parallel to but slightly below a plane commonly occupied by the lower portions of the front and rear wheels 16 and 18, whereby the wheels 50, which extend laterally substantially beyond the plane occupied by the front and rear wheels 16 and 18, are capable of preventing appreciable tilting of the motorcycle 10 as well as driving the same.

ELECTRIC GENERATING UNIT

Inertia wheel 54 is supported upon a transverse shaft 60 supported at its opposite ends within bearings in side plates 34 and 36. A hub 62 extends from one side of inertia wheel 54 and terminates in a pinion gear 64, the outer end of which is spaced from the inner surface of side plate 34. Inertia wheel 54 is insulated electrically from shaft 60 by an insulating bushing 66. The side of inertia wheel 54 opposite the hub 62 has an annular cavity 68 from the inner face of which projects another hub 70 which supports an annular electric armature 72 which is shown in cross section in FIG. 2. Without restriction thereto, it is preferred that the electric armature 72, which actually is a magnet, be formed from ceramic material containing metal powder and may be similar to the magnet 86 shown in applicant's prior U.S. Pat. No. 4,193,223. The armature 72 preferably is fixed to inertia wheel 54 for rotation therewith.

Figure 4:
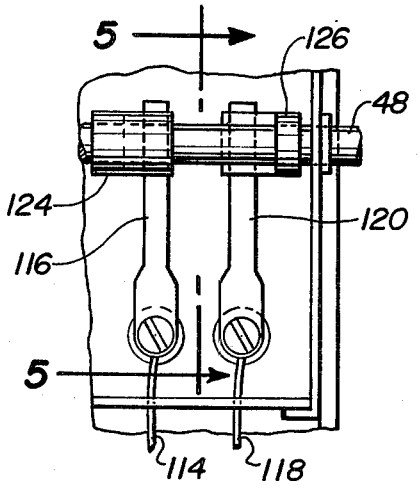
FIG. 4 is a fragmentary horizontal sectional view taken on the line 4—4 of FIG. 2 and illustrating electric circuit breakers which produce intermittent lighting of the electric lights on the motorcycle as the drive shaft rotates.

The electric generating unit also includes an electric field coil 74 comprising preferably a copper wire coil wound upon an insulating sleeve 76, between a pair of similar insulating discs 78, and disc 78 nearest side plate 36 is fixed thereto by suitable prongs 80, or otherwise. Associated with the field coil 74 is a stator comprising a plurality of radial fingers 82 which, for example, may be in cruciform configuration and the outer ends thereof are bent transversely to fingers 82 to form pole pieces 84 which are shown in FIG. 4 projecting toward the left from innermost insulating disc 78.

Figure 2:
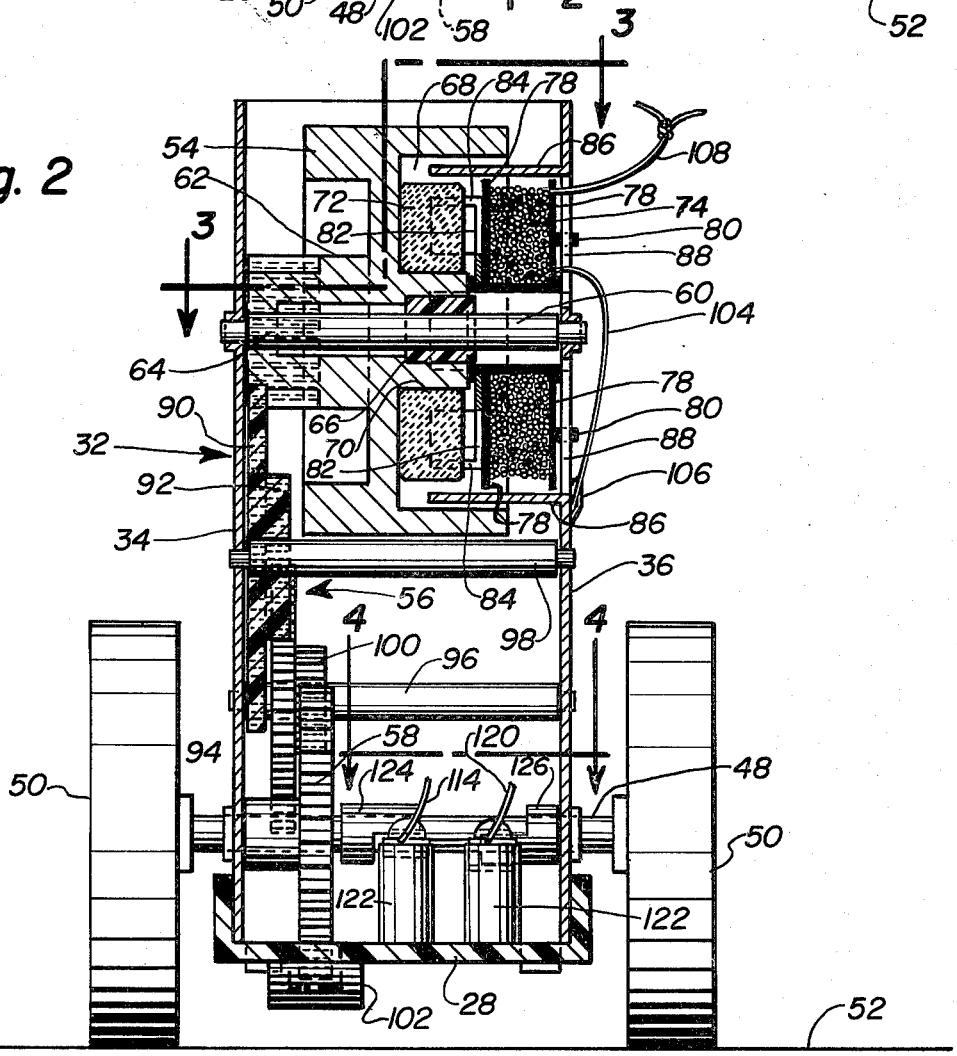
FIG. 2 is a sectional view of the gear train for the generator also comprising means to drive side wheels extending beyond opposite sides of the frame for purposes of propelling the motorcycle in driving direction, said sectional view being taken on line 2—2 of FIG. 1 and being shown on a larger scale than the view in FIG. 1.

Additional pole pieces 86 comprise fingers which are stamped from side plate 36 and extend perpendicularly thereto as clearly shown in FIG. 2, the pole pieces 86 being in the form of fingers stamped from openings 88 in side plate 36. The outermost portions of the pole pieces 86 at least partially overlie the electric armature 72 as clearly shown in FIG. 2, the pole pieces 84 also partially overlying the electric armature 72 to the same extent as pole pieces 86. Further, it is preferred that half of the pole pieces comprise the pole pieces 84 which are formed, for example, from the cruciform fingers 82 and the other half comprise the pole pieces 86 stamped from side plate 36, the respective groups of pole pieces being interspersed alternately for purposes of forming stator pole pieces evenly spaced circumferentially around the perimeter of electric armature 72 and all of the pole pieces being of equal radii with respect to the axis of shaft 60, as illustrated somewhat in phantom in FIG. 1.

From the foregoing, it will be seen that the field coil 74 is insulated from the metal housing 32 and also from the armature 72. Also, the armature 72 which is carried by inertia wheel 54 is insulated from the shaft 60 and metal housing 32 by virtue of a pair of intermediate gears 90 and 92 being formed from insulating material as shown in FIG. 2 by the cross-hatching, these gears respectively being of different diameters for speed multiplying functions, the gear 90 being of larger diameter and meshing with pinion gear 64. The smaller diameter insulating gear 92 meshes with larger diameter gear 94 on shaft 96 which also is parallel to shaft 98 upon which the gears 90 and 92 are mounted, said shafts also being supported within appropriate bearings in the side plates 34 and 36 as clearly shown in FIG. 2. Connected to gear 94 is a smaller diameter pinion gear 100 which meshes with drive gear 58, whereby all of the gears enumerated in the foregoing constitute the gear train 56 referred to above. In view of the fact that the drive gear 58 is of substantial diameter, to accommodate the same within the housing 32 and especially to prevent conflict with the bottom plate 28 of the elongated frame of the motorcycle, it will be seen from FIGS. 1 and 2 that a concavity 102 is formed in bottom plate 28 for the foregoing purpose.

In the preferred embodiment of the invention, it is desired that the electric lights 44 and 46 be energized intermittently and to accomplish this, the preferred circuit for the toy motorcycle 10 is as follows.

ELECTRIC CIRCUIT

Figure 6:
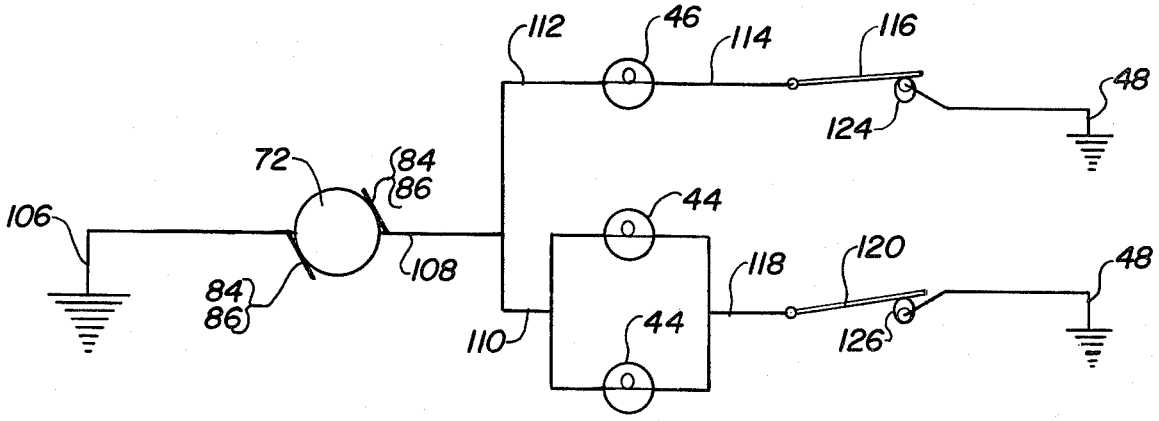
FIG. 6 is a schematic wiring diagram in which the ground comprises the metallic housing contained in the central enclosure of the frame of the motorcycle.

One end 104 of the wire comprising field coil 74 is attached to side plate 36 at 106 to constitute a ground for the circuit which is illustrated diagramatically in FIG. 6. The opposite end 108 of the field coil 74 has branch conduit 110 and 112 respectively going to headlights 44 and tail light 46 as also shown in FIG. 1. The circuit to tail light 46 has another conduit 114 which is connected to commutator 116 and from there to ground which constitutes drive gear 48 which, through the bearings in side plates 34 and 36, constitutes part of the ground .

Figure 5:
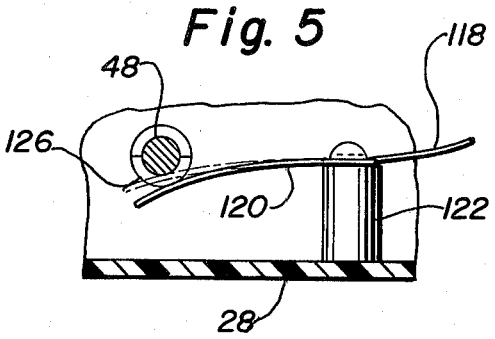
FIG. 5 is a fragmentary sectional view taken on the line 5—5 of FIG. 4 and showing further details of the circuit-breaking means.

The circuit for the headlights 44 has a return conduit 118 which is connected to a second commutator 120, commutators 116 and 120 being in the form of thin spring blades 122 as best shown in FIGS. 4 and 5, one end of the commutators 116 and 120 being secured to posts 122 formed on bottom plate 28, for example. The opposite ends of commutators 116 and 120 are arranged to be engaged by interrupted sleeves 124 and 126 formed of insulating material and having circular portions fixed to drive shaft 48, while approximately half of the circumference of said sleeves are engageable by the commutators 116 and 120, whereby intermittently, the commutators 116 and 120 are grounded by contact with drive shaft 48 but, when the remaining portion of the sleeves engage the commutators, flow of current stops to the head and tail lights for intermittent operation thereof.

Figure 3:
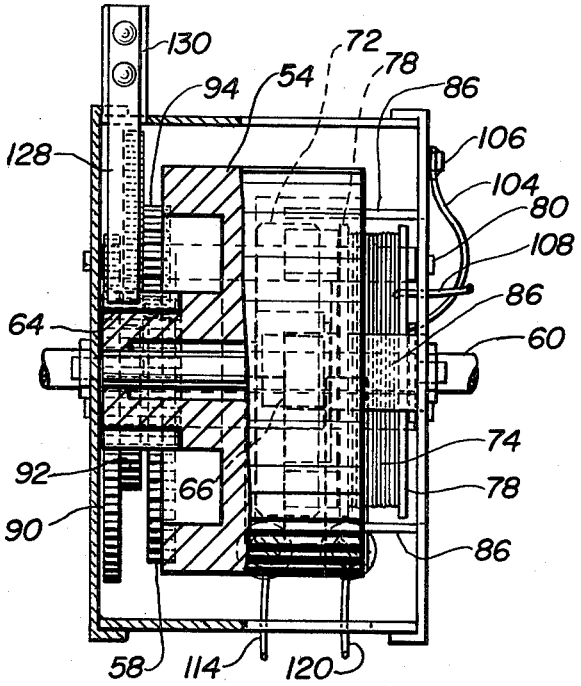
FIG. 3 is a fragmentary horizontal sectional view taken on the line 3—3 of FIG. 2 and illustrating among other things noise-making means and the manner in which it is operated.

For purposes of providing a simulated realistic sound for the toy motorcycle when it is operating, the present invention includes sound generating means in the form of a very simple structure comprising a leaf spring 128, as best shown in FIGS. 1 and 3, one end of which is secured by rivets or otherwise to a bracket 130 which is stamped and bent outwardly from the rear end plate of metal housing 32 as clearly shown in FIG. 1. The opposite end of leaf spring 128 engages the teeth of pinion gear 64 as also shown in FIGS. 1 and 3 and, when the motorcycle is in motion, the result produced by engagement of spring 130 with the pinion gear 64 resembles a clacking noise somewhat resembling the sound of a motorcycle engine, thus adding added interest to operation of the toy motorcycle by children or adults.

From the foregoing, it will be seen that the toy motorcycle can be placed upon a supporting surface 52 substantially in upright position and tilting of the same appreciably from that position is prevented by the engagement of the laterally disposed drive wheels 50 in conjunction with the front and rear freely rotatable wheels 16 and 18, the latter having no function in the driving operation of the motorcycle. By manually moving the motorcycle relative to supporting surface 52 in a forward direction a number of times for purposes of progressively accelerating the rotation of the inertia flywheel 54, such acceleration not only generates an electric current to intermittently light the front and rear electric lights but, of equal if not greater importance is the fact that the energy thus stored in the inertia flywheel constitutes the motor power for the motorcycle to move the same forwardly in whatever direction is dictated by the position of the front wheel 16 with respect to the elongated frame within which it is mounted. The frictional circumference of the drive wheels 50 engage the supporting surface 52 adequately to propel the motorcycle forwardly for a substantial distance, depending upon the degree of acceleration imparted to the inertia flywheel 54 as the result of such manual movements described above. The electric circuit is relatively simple and the inclusion of commutator means provides intermittent illumination of the head and tail lights, thereby affording additional interest incident to playing with the motorcycle.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A toy motorcycle having at least one electric light bulb mounted thereon and comprising in combination an elongated frame having front and rear portions extending from a central enclosure and comprising complementary side plates shaped to form said enclosure, front and rear wheels supported by said front and rear portions of said frame for free rotation, a metal housing supported within said enclosure and containing: a gear train comprising interengaging gears supported upon shafts extending transversely through bearings in opposite side plates of said housing, a drive shaft extending through bearings in the lower portions of said side plates of said housing at opposite sides of said central enclosure and a pair of drive wheels having friction rims supported respectively upon opposite ends of said drive shaft and dispersed outwardly of the opposite sides of said side plates of said central enclosure and the rims of the wheels being in a plane slightly below a parallel plane engaging the lowest portions of said front and rear wheels, whereby said drive wheels can engage a supporting surface to prevent any appreciable side tilting of the motorcycle when all of said wheels engage said surface, said drive wheels also being rotatable by engagement with said surface when the motorcycle is pushed manually therealong, an inertia flywheel mounted upon a transverse shaft in said housing, electric generating means comprising an electric armature coaxially fixed to said flywheel for rotation therewith, an electric field coil and stator unit supported by one side of said metal housing coaxially with said armature, said stator comprises finger-like pole pieces spaced circumferentially around the perimeter of said armature and projecting laterally from one face of a wire field coil, half of said pole pieces comprise the outer ends of said fingers bent perpendicularly from radial fingers within a plane adjacent one side of said field coil and the other half of said pole pieces comprise fingers stamped from the metal side plate of the housing which supports said field coil and are bent perpendicularly to the plane of said side plate and interspersed between the first half of said pole pieces to form a circular pattern thereof surrounding the periphery of said electric armature, an electric circuit extending from one end of said coil and connected to said metal housing to serve as a ground and said circuit also extending from the other end of said coil to said electric light bulb, gears of said train respectively on said drive shaft and said transverse shaft of said armature, and intermediate gears mounted between and meshing with said aforementioned gears of said train operable to multiply the speed of said armature and inertia wheel relative to said drive shaft, whereby as the drive shaft is operated by said inertia wheel to propel the motorcycle forwardly by rotation of said drive wheels the armature and stator generate electric current to illuminate the electric light bulb through a circuit extending from said stator.

2. The toy motorcycle according to claim 1 further including commutator means connected in said electric circuit and comprising metal contacts in said circuit engageable with the drive shaft and including an interrupted sleeve of insulation on said drive shaft engageable with said metal contacts and operable sequentially to lift them from engagement with said drive shaft to interrupt the supply of current to said electric light bulb and provide intermittent lighting thereof.

3. The toy motorcycle according to claim 1 further including insulation discs abutting opposite faces of said wire field coil, insulation means connecting one of said discs to the side of said metal housing which supports said field coil, said coil also having an insulation hub through which the shaft of said armature extends, said inertia flywheel being supported by an insulating bushing upon said transverse shaft of said inertia flywheel to insulate the same therefrom, and the gear of said train which engages the gear on said flywheel being of insulating material, whereby said armature is insulated from said stator and field coil.

4. The toy motorcycle according to claim 1 in which the rear end portion of said elongated frame has a tail light and a fork on said frame has a miniature handlebar supporting at least one headlight, and circuit means between said electric generating means and said tail and head lights.

5. The toy motorcycle according to claim 1 further including means to produce a clacking sound somewhat resembling the sound of a motorcycle and comprising a sound-generating leaf spring fixedly connected at one end to the interior of said central enclosure of said elongated frame and said spring having a portion engaging the teeth of one of the gears of said gear train to effect said clacking sound when said motorcycle is in motion.

* * * * *